US005572964A

United States Patent [19]

Cogneville et al.

[11] Patent Number: 5,572,964

[45] Date of Patent: Nov. 12, 1996

[54] CONTROL PROCESS FOR AN INTERNAL COMBUSTION ENGINE FUEL PUMP

[75] Inventors: Francis Cogneville, St-Germain-Les-Arpajon; Gerard Saint-Leger, Villejuif; Pierre Vaillard, Igny, all of France

[73] Assignee: Regie Nationale des Usines Renault, Boulogne-Billancourt Cedex, France

[21] Appl. No.: 332,407

[22] Filed: Oct. 31, 1994

[30] Foreign Application Priority Data

Oct. 29, 1993 [FR] France ..... 93 12924

[51] Int. Cl.[6] ..... F02M 17/00; F02M 37/04

[52] U.S. Cl. ..... 123/179.17; 123/516

[58] Field of Search ..... 123/179.17, 516, 123/497, 498, 499, 510

[56] References Cited

U.S. PATENT DOCUMENTS

| | | | |
|---|---|---|---|
| 3,548,796 | 12/1970 | Gastinne | 123/179.17 |
| 4,984,554 | 1/1991 | Ariga | 123/516 |
| 5,074,272 | 12/1991 | Bostick | 123/516 |
| 5,175,663 | 12/1992 | Iwabuchi et al. . | |
| 5,327,872 | 7/1994 | Morikawa | 123/179.17 |
| 5,351,666 | 10/1994 | Pronkal | 123/179.17 |
| 5,373,829 | 12/1994 | Schuers | 123/516 |
| 5,425,342 | 6/1995 | Ariga | 123/179.17 |

FOREIGN PATENT DOCUMENTS

| | | | |
|---|---|---|---|
| 2119239 | 8/1972 | France . | |
| 2829810 | 1/1979 | Germany | 123/179.17 |
| 58-204957 | 11/1983 | Japan . | |
| 91/18196 | 11/1991 | WIPO . | |

*Primary Examiner*—Carl S. Miller

*Attorney, Agent, or Firm*—Oblon, Spivak, McClelland, Maier & Neustadt, P.C.

[57] ABSTRACT

A control process for a fuel pump installed in a fuel circuit of a motor vehicle internal combustion engine. The fuel pump is of the electric drive type and is controlled by the engine control system. The fuel pump is actuated in advance of the operation of the starter for a predetermined time period when the electronic engine control system is switched on. The duration of the predetermined delay time period is adjusted as a function of predetermined criteria such as whether the engine has been previously operated and if a manual signal such as the accelerator pedal to a full throttle position has been given by an operator.

25 Claims, 3 Drawing Sheets

CONTROL PROCESS FOR AN INTERNAL COMBUSTION ENGINE FUEL PUMP

BACKGROUND OF THE INVENTION

1. Field of the Invention

This invention relates to a control process for the driving of a fuel pump of an internal combustion engine that is installed, in particular, in a motor vehicle. This invention relates more particularly to a control process intended to facilitate the pressurization of the fuel circuit of the engine before starting the latter.

2. Discussion of the Background

The supply circuit of an internal combustion engine traditionally includes a circuit for supplying the fuel under pressure from a storage tank to the electronic injectors controlled by an electronic engine control which determines the amount of fuel to be injected depending on the operating conditions of engine. Traditionally, the injectors are supplied with fuel under a constant pressure, the amount of injected fuel being determined by the duration of the opening of the injectors or injection time.

The fuel circuit is equipped with an electric pump which delivers the fuel at a given pressure regardless of the operating speed of the engine. The use of this pump is directly controlled by the electronic engine control system which determines the operating range of the pump so as to prevent any danger of accidental leakage of the fuel. Thus the pump is actuated only after the cranking of the starter and it is stopped immediately after engines is stopped.

To facilitate the starting of the engine, however, the prestarting of the fuel pump is allowed for a predetermined duration, also called delay time, as soon as contact has been made, i.e., as soon as the engine control system is switched on. Thus, the fuel circuit is already under pressure when the starter is actuated, which makes it possible to inject immediately the desired amounts of fuel. The delay time 10 traditionally is constant for a given engine and is relatively short, on the order of a few seconds, for reasons of safety. It has been determined that such a delay time is insufficient to assure the pressurizing of the fuel circuit under certain circumstances and particularly when the fuel circuit is empty, which is the case when a motor vehicle comes off the production line.

Therefore, under these particular circumstances, a relatively long actuation of the starter results in a long operation of the fuel pump which is necessary for the fuel pressure to rise and thus make it possible to inject sufficient amounts of fuel. This relatively prolonged actuation of the starter can prove damaging to the service life of the electric battery and of the starter of the vehicle which are very heavily acted on.

SUMMARY OF THE INVENTION

The object of this invention is therefore to eliminate this drawback of the prior art by proposing a control process for the fuel pump of an internal combustion engine in which the delay time duration is adapted in advance of the needs of the engine.

The process according to the invention is more particularly intended to control a fuel pump installed in the fuel circuit of a motor vehicle internal combustion engine, with the fuel pump being of the electric drive type and being controlled by the engine control system. This control process actuates the fuel pump in advance for predetermined delay time period when the electronic engine control system is switched on.

The duration of the delay time period is adjusted as a function of predetermined criteria or according to predetermined operating criteria of the engine. Further, the delay time periods may be adjusted only subject to an enabling protocol initiated by an operator or as a function of the pressure of the fuel prevailing in the fuel circuit.

According to another characteristic of the control process of a fuel pump according to the invention, the delay time period can assume only two values, a first value normally used each time the electronic engine control system is activated, and a second value used only during predetermined circumstances, the first delay time period being appreciably shorter than the second delay time period. The second delay time period or long delay time is more particularly intended to be used when the fuel line is empty. The long delay time is more particularly intended to be used before the engine performs its first start.

The long delay time is used after the engine control system has detected the sending, by an operator, of a predetermined signal and provided that the engine has never operated previously. The predetermined signal is defined by the floorboard position of the accelerator pedal. The engine may be considered as having operated when it has reached a predetermined rotation speed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
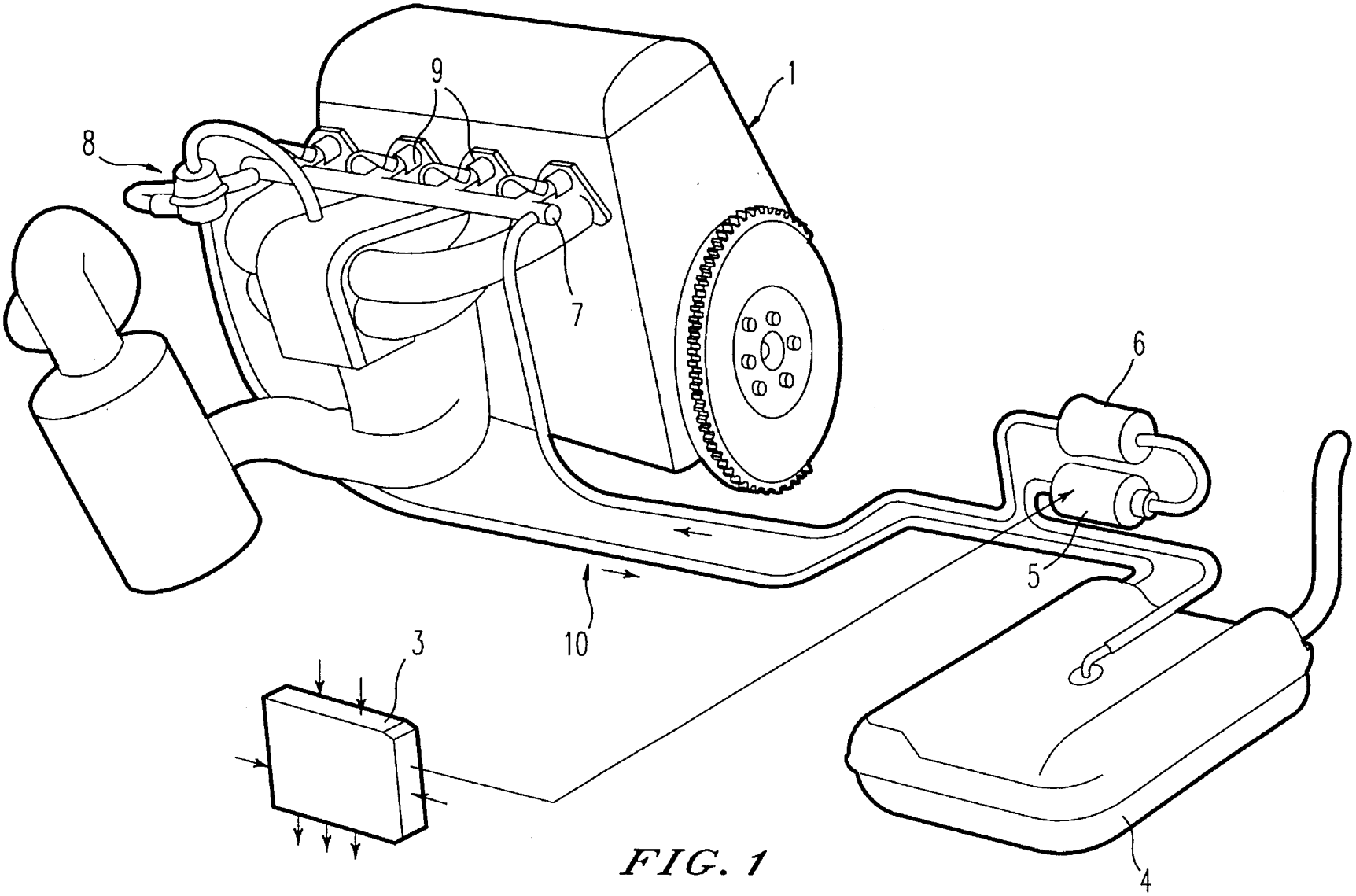
FIG. 1 is a diagrammatic view of the fuel circuit of an internal combustion engine.

preferring now to the drawings, wherein like reference numeral designate identical or corresponding parts throughout the several views, and more particularly to FIG. 1 thereof, there is illustrated a fuel injection system for an internal combustion engine. The system includes a fuel circuit 10 for the fuel under pressure from fuel tank 4 to electronic injectors 9. Electronic injectors 9 are controlled by an electronic engine control system 3 which determines the opening time of the various injectors and therefore the amount of fuel injected. The electronic injectors 9 are connected to engine control system 3 through wires (not illustrated).

The fuel supply circuit 10 comprises an electrically driven feeding pump 5. Inside pump 5, a safety valve prevents overpressurization of the fuel system and at the outlet, a nonreturn valve prevents the cutoff of the circuit (or backflow of fuel) when thee engine is stopped. Pump 5 sends the fuel through a filter 6, then into an injection ramp 7 which communicates with the various injectors. Element 7 serves to distribute the fuel to the injectors. The injection pressure differential, between the fuel supply circuit and the intake manifold is kept constant, regardless of the flow rate of the injectors 9, by a pressure regulator 8 which monitors the rate of return of the excess fuel to the tank 4.

The engine control system 3 includes a computer having a central processing unit or CPU, a random access memory or RAM, a read-only memory or ROM, analog-to-digital converters and various input and output interfaces. The engine control system 3 receives various characteristic input signals on the operation of the engine such as a load, speed, water temperature, manifold pressure, etc. It performs operations and, in turn, generates output signals intended for the directly controlled elements and in particular the fuel injectors 9 and the fuel pump 5.

Figure 2:
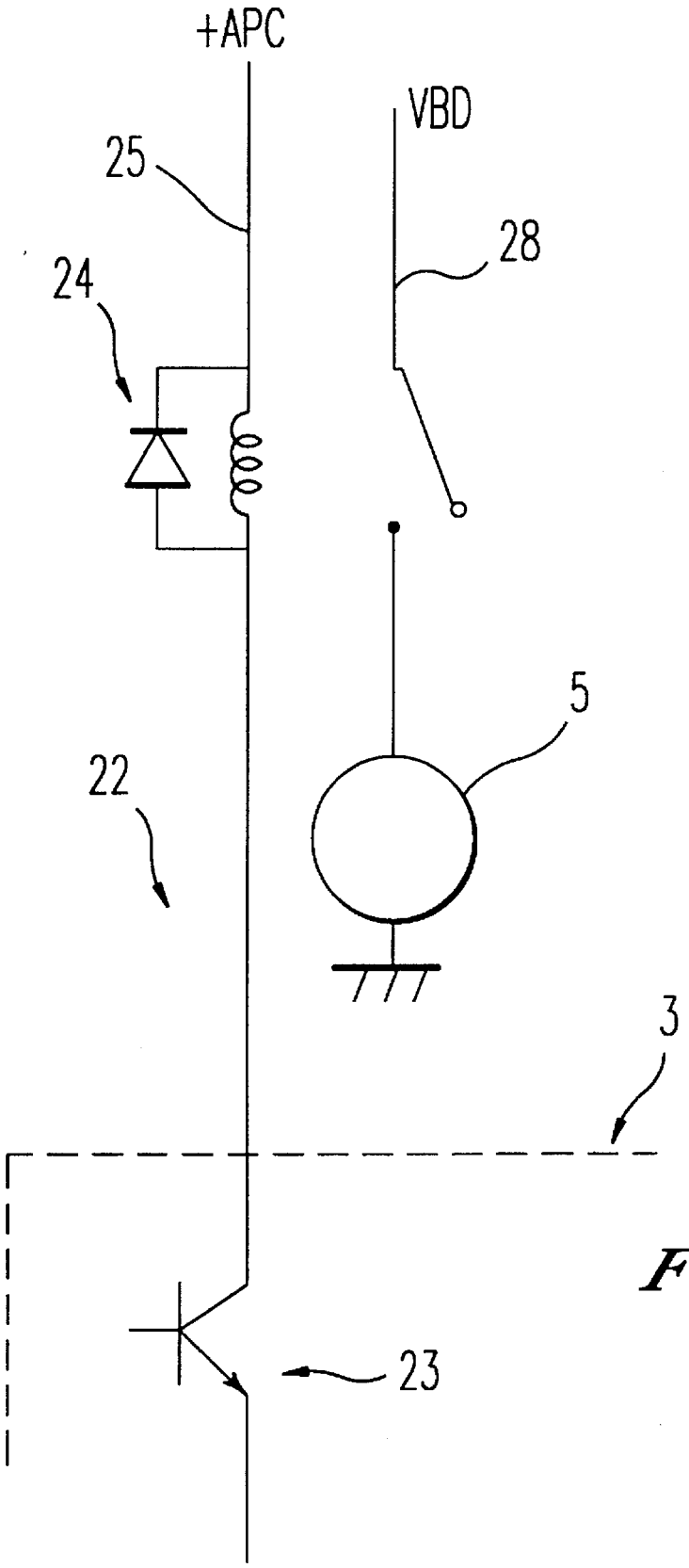
FIG. 2 is a partial electric diagram of the control of the fuel pump by the engine control system.

In order to activate the fuel pump, the engine control system 3 therefore includes, as illustrated in FIG. 2, an output 22 having a controlled switch such as a transistor 23, controlling the powering of a relay 24 connected to the + terminal of the battery of the vehicle through connection line 25, working with a contactor, not shown, actuated by the vehicle ignition key (+APC), to prevent the fuel pump from being started at the wrong time. The tripping of relay 24 then closes line 28 that connects the battery (VBD) directly to the fuel pump 3 to drive the fuel pump 5.

Traditionally, the engine control system 3 controls the actuation of fuel pump 5 in advance for a period known as a delay time, as soon as contact is made. Contact is determined either directly by the recognition of the key "off"-key "on" transition or else directly by the powering of the engine control system 3. The control process of the fuel pump according to the invention adjusts or changes this delay time according to certain predetermined criteria.

Figure 3:
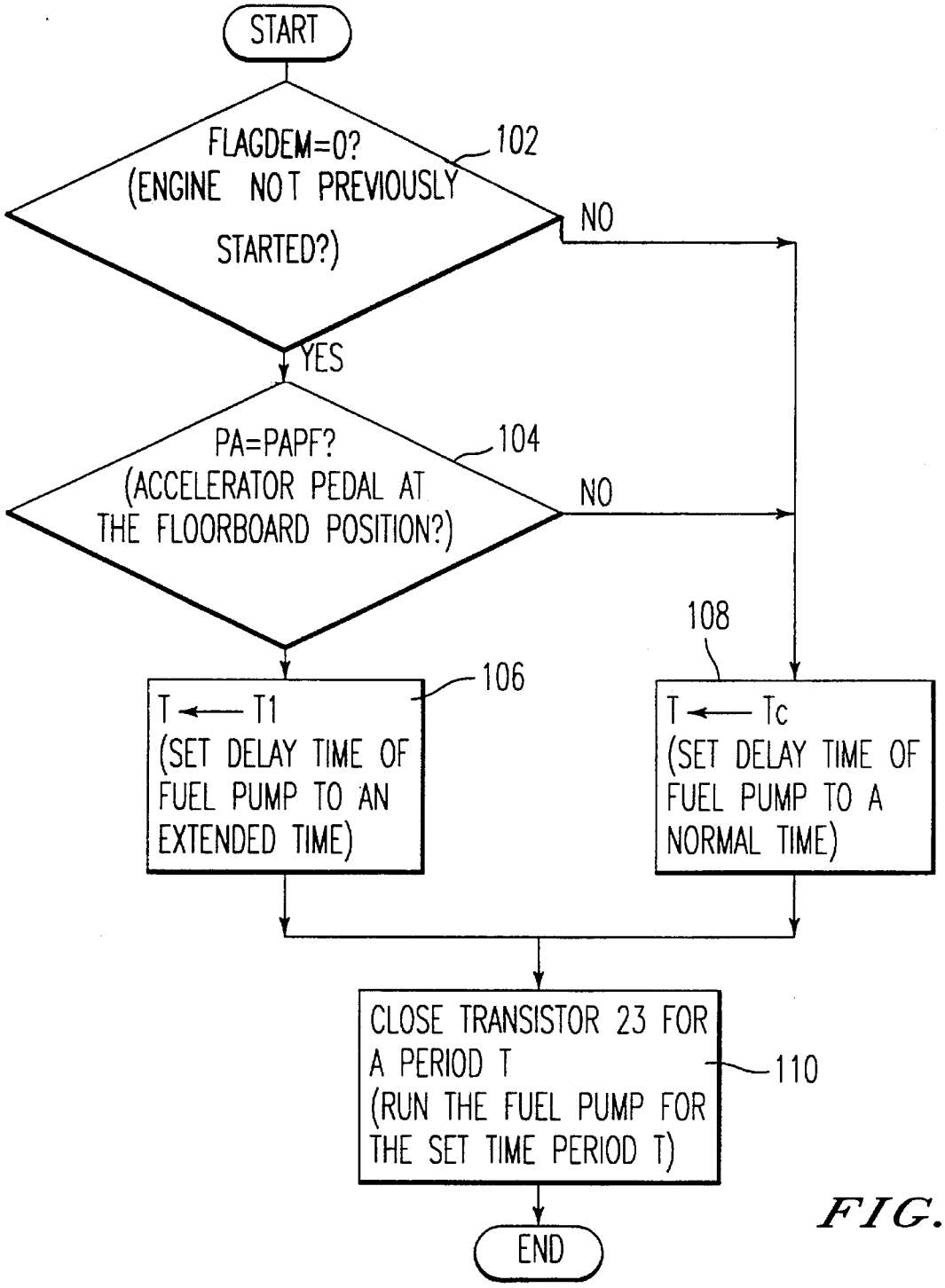
FIG. 3 is a flow chart specifying the various stages of the process according to the invention.

FIG. 3 presents diagrammatically an algorithm intended to adapt the delay time during the very first start of the engine when the vehicle on which it is mounted leaves the assembly line. To do this, the engine control system has two predetermined delay time values: a value T1 of about 30 seconds intended only for the first start of the engine so as to permit the pressurizing of the initially empty fuel circuit and a value Tc of about 1 second for the subsequent starts.

The choice of the long delay time value T1 by engine control system 3 is then determined by the combination of two separate criteria: the absence of any prior operation of the engine and the recognition of a particular signal which is caused deliberately by an operator and which is recognized by the engine control system when it is switched on, for example, the accelerator pedal at the floorboard position. This signal is identified either directly from a potentiometer connected to the accelerator pedal, or indirectly from the full load position of the throttle.

The combination of the two criteria makes it possible to use the long delay time T1 with maximum safety. Delay time T1 is triggered only by a particular manipulation defining an enabling protocol, which eliminates the danger of unexpected triggering which could lead to a long and dry running of the fuel pump. Furthermore, the subsequent user of the vehicle cannot recreated the initial conditions of the delay time.

The process of the invention will now be described with respect to FIG. 3. In FIG. 3, step 102 reads the contents of a specific memory location or flag (FLAGDEM) of the computer 3 (EEPROM non-volatile storage) which characterizes the fact of whether the engine has already operated or not. The memory location or flag, which is initially set to "0", is set to "1" as soon as the engine has operated. To determine that the engine has operated, it is possible to take, for example as criteria, the fact that it has run above a given speed of rotation (e.g., 1000 RPM); the code "1" is assigned to this case. The strategy for recognition of engine operation and for updating the contents of the FLAGDEM register or memory location is standard and has not been shown.

If the engine was previously started and therefore, the content of FLAGDEM is "1", then a short delay time Tc such as 1 second is set in step 108. Transistor 23 is therefore closed for a period equal to Tc.

If the content of FLAGDEM is "0" in step 102, indicating the engine has not been previously started, the engine control system then begins waiting for the enabling protocol in step 104. Therefore, for a given period of time, it waits to receive a predetermined signal, for example the floorboard positioning of the accelerator pedal. The position information is observed of the throttle PA supplied to computer 3 by a specific sensor and which is used furthermore to calculate the injection time, so as to indicate the full supply position, PAPF, corresponding to the floorboard position of the accelerator pedal. Either the signal is identified and then the long delay time T1 is set step 106, or the signal is not identified and the delay time Tc is set in step 110.

A certain number of safety devices, not detailed in the flowchart of FIG. 3, accompany the use of the process. Thus, long delay time T1 is immediately stopped by the cutoff of contact, which assures the safety of the system in case of failure of the fuel circuit, such as a fuel leak. Furthermore, in case of memory failure or of failure of a butterfly sensor, the short delay time Tc is systematically used.

The process according to the invention therefore makes it possible in a simple way, by simple modification of the control program of computer 3 and without the use of any new hardware, to use a delay time T1 adapted to the first start, which makes it possible to reduce the time of the first start up and therefore to prevent overheating of the starter and wear on the battery. Once the vehicle has been started, the delay time is set to the value Tc, which assures a particularly reliable operation of the engine.

It is possible to envision a resetting of the FLAGDEM register to "0" during an aftersale servicing involving the fuel-circuit (changing of the tank, etc.) to make possible again a long delay time T1.

Of course, the invention is in no way limited to the embodiment described and illustrated which was given by way of example. Rather, the invention comprises all the technical equivalents of the means described as well as their combinations if they are made in its spirit. Thus, if it can be envisaged to adapt the value of the delay time to respond to some particular operating circumstances or other vehicle, it can also be envisaged to adapt the value of the delay time during each start-up, for example from the pressure information of the fuel in the fuel circuit delivered by a pressure sensor placed on injection ramp 7, the delay time then being extended, subject to a maximum safety duration, until the pressure prevailing in the fuel supply circuit reaches a predetermined operating pressure of the electronic injectors 9.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A method for controlling a fuel delivery system, comprising the steps of:

activating an engine control system which is connected to an engine;

determining if the fuel delivery system is in at least a partially empty condition;

determining if an operator has manually set an input device, indicating that an electric fuel pump is to run for an extended period of time;

operating the electric fuel pump for a first predetermined period of time, when the fuel delivery system is in at least a partially empty condition and the operator has manually set the input device to indicate that the electric fuel pump is to run for the first predetermined period of time; and operating the electric fuel pump for a second predetermined period of time which is less than the first predetermined period of time, when at least one of the fuel delivery system is not in at least a partially empty condition and the operator has not manually set the input device to indicate that the electric fuel pump is to run for the first period of time.

2. A method according to claim 1, wherein the step of determining if the fuel delivery system is in at least a partially empty condition determines that the partially empty condition exists when the engine has never been started.

3. A method according to claim 1, wherein the step of determining if the fuel delivery system is in at least a partially empty condition determines that the partially empty condition exists when repair work has been performed on the fuel delivery system.

4. A method according to claim 1, wherein the step of determining if the operator has manually set the input device examines if a fuel control input is at a maximum fuel flow position.

5. A method according to claim 2, wherein the step of determining if the operator has manually set the input device examines if a fuel control input is at a maximum fuel flow position.

6. A method according to claim 1, wherein the first predetermined period of time is at least 4 times longer than the second predetermined period of time.

7. A method according to claim 1, further comprising the step of:

starting the engine after operation of the fuel pump.

8. An apparatus for controlling fuel delivery in a motor vehicle, comprising:

an electric fuel pump;

an engine;

an engine control system;

a fuel delivery system;

a manual input device for indicating that the electric fuel pump is to run for an extended period of time;

means for activating the engine control system;

means for determining if the fuel delivery system is in at least a partially empty condition;

means for determining if an operator has manually set the manual input device, indicating that the electric fuel pump is to run for the extended period of time;

means for operating the electric fuel pump for a first predetermined period of time, when the fuel delivery system is in at least a partially empty condition and the operator has manually set the manual input device to indicate that the electric fuel pump is to run for the first predetermined period of time; and means for operating the electric fuel pump for a second predetermined period of time which is less than the first predetermined period of time, when at least one of the fuel delivery system is not in at least a partially empty condition and the operator has not manually set the manual input device to indicate that the electric fuel pump is to run for the first period of time.

9. An apparatus according to claim 8, wherein the means for determining if the fuel delivery system is in at least a partially empty condition determines that the partially empty condition exists when the engine has never been started.

10. An apparatus according to claim 8, wherein the means for determining if the fuel delivery system is in at least a partially empty condition determines that the partially empty condition exists when repair work has been performed on the fuel delivery system.

11. An apparatus according to claim 8, wherein the means for determining if the operator has manually set the manual input device examines if a fuel control input is in a maximum fuel flow position.

12. An apparatus according to claim 9, wherein the means for determining if the operator has manually set the manual input device examines if a fuel control input is in a maximum fuel flow position.

13. An apparatus according to claim 8, wherein the first predetermined period of time is at least 4 times longer than the second predetermined period of time.

14. An apparatus according to claim 8, further comprising:

means for starting the engine after operation of the fuel pump.

15. A method for controlling a fuel delivery system, comprising the steps of:

activating an engine control system which is connected to an engine;

determining if a predetermined condition exists;

adjusting a delay time period of an electic fuel pump to one two values depending on if the predetermined condition is determined to exist; and operating the electric fuel pump for the delay time period.

16. A method according to claim 15, further comprising the step of:

setting the predetermined condition using operating criteria of the engine.

17. A method according to claim 16, wherein the step of setting the predetermined condition sets the predetermined condition using operating criteria of the engine, only when an operator sets an enabling condition.

18. A method according to claim 16, further comprising the step of:

changing the delay time period as a function of fuel pressure of the fuel delivery system.

19. A method according to claim 15, wherein:

a first of said two values is used under ordinary engine starting conditions and a second of said two values is used only when the predetermined condition exists, the second of said two values being at least four times as long as the first of said two values.

20. A method according to claim 19, wherein the predetermined condition exists when the fuel delivery system is not full of fuel.

21. A method according to claim 19, wherein the predetermined condition exists before the engine is ever started.

22. A method according to claim 21, wherein the predetermined condition exists before the engine is ever started and an operator sets an enabling condition.

23. A method according to claim 22, wherein the enabling condition set by the operator is placement of an accelerator pedal of a motor vehicle to a floorboard position.

24. A method according to claim 22, wherein the engine is considered to have started when the engine has reached a predetermined rotation speed.

25. A method according to claim 15, further comprising the step of:

starting the engine after operation of the fuel pump.

* * * * *